US009061294B2

(12) United States Patent
Kajuch et al.

(10) Patent No.: US 9,061,294 B2
(45) Date of Patent: Jun. 23, 2015

(54) JOINT CONNECTOR

(75) Inventors: Peter Kajuch, Brookfield, WI (US); Todd W. Leonhard, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 853 days.

(21) Appl. No.: 12/689,076

(22) Filed: Jan. 18, 2010

(65) Prior Publication Data

US 2010/0163652 A1 Jul. 1, 2010

Related U.S. Application Data

(63) Continuation-in-part of application No. 12/029,590, filed on Feb. 12, 2008, now abandoned.

(51) Int. Cl.

| | |
|---|---|
| ***A47K 3/00*** | (2006.01) |
| ***B05B 7/04*** | (2006.01) |
| ***B05B 15/00*** | (2006.01) |
| ***E03C 1/084*** | (2006.01) |
| *B05B 1/18* | (2006.01) |
| *B05B 1/26* | (2006.01) |
| *E03C 1/08* | (2006.01) |

(52) U.S. Cl.

CPC ..... *B05B 7/0425* (2013.01); *B05B 1/18* (2013.01); *B05B 1/265* (2013.01); *B05B 15/008* (2013.01); *E03C 1/084* (2013.01); *E03C 2001/082* (2013.01)

(58) Field of Classification Search

USPC ..... 4/615; 239/428.5, 8, 287.1, 587.1, 239/425.5

See application file for complete search history.

(56) References Cited

U.S. PATENT DOCUMENTS

| | | | | |
|---|---|---|---|---|
| 159,142 | A | | 1/1875 | Baird |
| 2,510,396 | A | | 6/1950 | Goodrie |
| 2,935,265 | A | | 5/1960 | Richter |
| 2,989,249 | A | | 6/1961 | Richter |
| 2,990,122 | A | * | 6/1961 | Blumberg et al. ..... 239/441 |
| 3,031,147 | A | | 4/1962 | Goodrie |
| 3,282,227 | A | | 11/1966 | Nielsen |
| 3,786,995 | A | * | 1/1974 | Manoogian et al. ..... 239/428.5 |
| 3,797,747 | A | | 3/1974 | Buzzi et al. |
| 3,799,450 | A | | 3/1974 | Braukman |
| 4,072,270 | A | | 2/1978 | Harmony |
| 4,134,548 | A | | 1/1979 | Harmony |
| 4,191,332 | A | | 3/1980 | De Langis et al. |

(Continued)

FOREIGN PATENT DOCUMENTS

| | | | |
|---|---|---|---|
| JP | 2002-102100 | A | 4/2002 |
| WO | 98/02250 | A1 | 1/1998 |

(Continued)

OTHER PUBLICATIONS

Office Action on U.S. Appl. No. 12/029,590, mail date Feb. 2, 2011, 6 pages.

(Continued)

*Primary Examiner* — Lauren Crane
(74) *Attorney, Agent, or Firm* — Foley & Lardner LLP

(57) ABSTRACT

A ball joint connector is provided for linking a showerhead to a water supply pipe. The connector has an internal venturi that draws air into the connector to aerate water being provided to the showerhead. A flow control member is disposed in a fluid pathway connected to the venturi, preventing spraying or leaking out the air inlet, while reducing noise associated with the air induction.

21 Claims, 3 Drawing Sheets

(56) References Cited

U.S. PATENT DOCUMENTS

| | | | | |
|---|---|---|---|---|
| 4,523,718 | A | 6/1985 | Pearson | |
| 4,537,358 | A | 8/1985 | Anderson | |
| 4,542,853 | A | 9/1985 | Diamond | |
| 4,573,639 | A | 3/1986 | Logue | |
| 4,623,095 | A | 11/1986 | Pronk | |
| 5,054,688 | A | 10/1991 | Grindley | |
| 5,071,070 | A | 12/1991 | Hardy | |
| 5,111,994 | A * | 5/1992 | Gonzalez | 239/428.5 |
| 5,154,355 | A | 10/1992 | Gonzalez | |
| 5,172,432 | A | 12/1992 | Béland | |
| 5,279,324 | A | 1/1994 | Schutz et al. | |
| 5,356,076 | A | 10/1994 | Bishop | |
| 6,182,703 | B1 | 2/2001 | Brice | |
| 6,260,273 | B1 | 7/2001 | Brice | |
| 6,343,750 | B1 | 2/2002 | Engel | |
| 6,357,675 | B1 | 3/2002 | Schorn et al. | |
| 6,471,141 | B2 | 10/2002 | Smith et al. | |
| 6,776,901 | B1 * | 8/2004 | Vaughan et al. | 210/190 |
| 6,796,518 | B2 | 9/2004 | Douglas et al. | |
| 7,427,037 | B2 * | 9/2008 | Frazee | 239/109 |
| 2004/0199995 | A1 | 10/2004 | Bui | |
| 2007/0158470 | A1 | 7/2007 | Taylor et al. | |
| 2007/0163040 | A1 * | 7/2007 | Bertrand | 4/615 |
| 2007/0194153 | A1 | 8/2007 | Frazee | |
| 2007/0257136 | A1 | 11/2007 | Kogelbauer | |
| 2008/0272212 | A1 | 11/2008 | Denzler | |
| 2009/0045268 | A1 | 2/2009 | Selander et al. | |
| 2009/0101212 | A1 | 4/2009 | Cullin | |
| 2009/0202293 | A1 | 8/2009 | Kajuch et al. | |

FOREIGN PATENT DOCUMENTS

| | | | |
|---|---|---|---|
| WO | 2005/054591 | A1 | 6/2005 |
| WO | 2006/077109 | A1 | 7/2006 |
| WO | 2009/068236 | A1 | 6/2009 |

OTHER PUBLICATIONS

Office Action on U.S. Appl. No. 12/029,590, mail date Jul. 14, 2010, 5 pages.

* cited by examiner

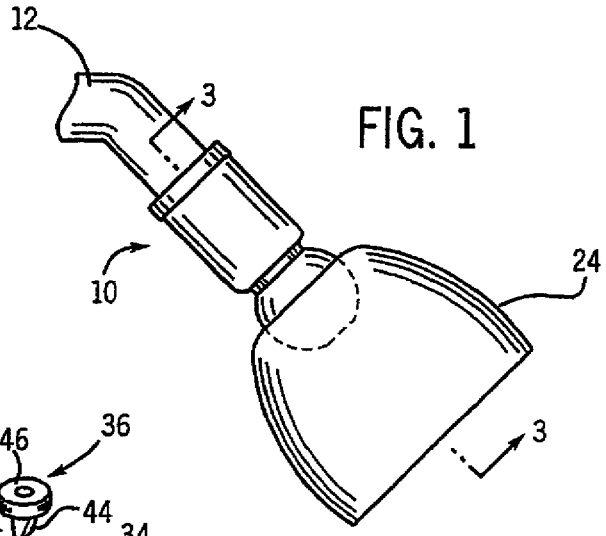
FIG. 1
FIG. 2
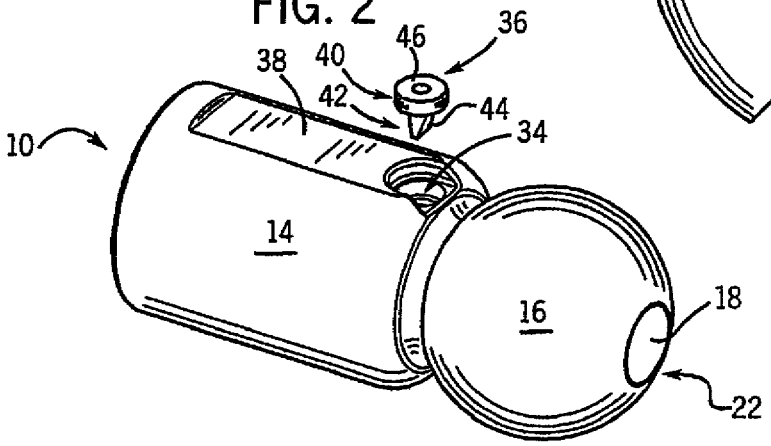
FIG. 3
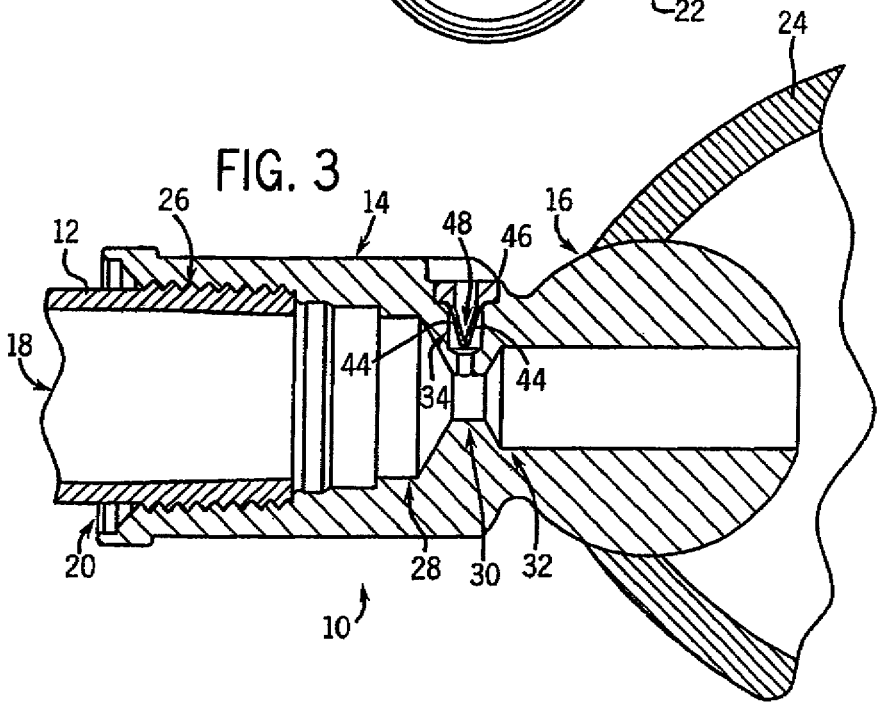

JOINT CONNECTOR

CROSS-REFERENCE TO RELATED APPLICATIONS

This application is a Continuation In Part of U.S. Ser. No. 12/029,590 filed Feb. 12, 2008.

BACKGROUND OF THE INVENTION

The present invention relates to ball joints for showerheads. More particularly it relates to the provision of an air induction system associated with such ball joints to heighten the perceived water volume.

Primarily for water conservation reasons the flow rate to conventional showerheads has been restricted. However, this can lead a consumer to perceive the shower as being less forceful than desired.

It is known in connection with a variety of faucets and showerheads that aerating the water stream can make a given volume of water flow appear more bulky and substantial. Hence, aerating systems are often attached to the outlet of a faucet spout, and sometimes integrated into a showerhead. See e.g. U.S. Pat. Nos. 6,471,141 and 6,796,518 and U.S. patent application publications 2004/0199995 and 2007/0158470.

However, associating the aeration system with the showerhead itself, or the faucet spout, can disrupt the aesthetics, and in some cases can add complexity to the manufacturing of the product. One such aerating low-flow showerhead accomplishes this through a variety of moving parts. Further, associating the aeration system with the showerhead itself does not provide a solution for aerating the millions of existing showerheads which don't have this capability.

Hence, there were attempts to place the aeration system on a separate ball joint upstream of the showerhead, which would be hidden by the showerhead. See e.g. U.S. Pat. Nos. 5,111,994, 5,154,355 and 6,260,273, and U.S. patent application publication 2007/0193153. The approach used in these designs was to place a radial air inlet at the ball joint, and associate it with a venturi passage so as to induce air into the water flow in the joint. In this regard, as water passes through a throat of the venturi, the water velocity increases and the pressure decreases. The resulting negative pressure draws in ambient air through the radial inlet. The air then mixes with the water to produce an aerated water supply.

These ball joint-related designs are not without their own drawbacks. For example, their air inlet ports are nothing more than uncovered holes formed in the water supply line. This creates the possibility of water leaking back out the air inlet, creating a path for water waste, spitback, or water spray into the main bath area. Further, designs of this type can create undesirable noise such as a whistling or a roaring sound.

Hence, a need still exists for improved ways to aerate showerhead flow while avoiding these problems.

SUMMARY OF THE INVENTION

The present invention provides a joint connector for linking a water supply to a showerhead. The joint connector has a housing having an inlet section at one end suitable to connect to a water supply pipe, an outlet section at an opposed end suitable to mount the showerhead thereon, and a central portion there between. There is a passageway extending axially through the housing from the inlet section, through the central portion, and through the outlet section. The passageway is suitable to carry water there through, and a portion of the passageway in the central portion forms a venturi.

There is also an air inlet port positioned in the central portion and extending radially from the passageway to an exterior wall of the housing so as to be suitable to let air pass through the air inlet port into the housing. Further, an insert positioned within the air inlet port (e.g. to provide one-way flow and/or to reduce noise).

In preferred forms of the invention the insert is in the form of a check valve that permits air flow through the inlet port into the passageway, but restricts reverse flow from the passageway through the inlet port. One such check valve is an elastomeric duckbill check valve.

Surprisingly it has been found that this type of check valve greatly reduces noise associated with the joint while still controlling reverse flow through the air inlet. A particularly desirable placement for the intersection between the air inlet and the passageway is the throat of the venturi. Alternatively, noise reduction without check valve function can be obtained by using a cylindrical/sleeve form insert.

Various refinements are also possible such as having the inlet section provided with a flat area on its upper exterior which extends to the air inlet port (to provide a hidden position for the insert), providing the inlet section with interior threads (to facilitate linkage to a water supply pipe), and providing the outlet section with a generally ball-shaped exterior (to facilitate mounting a showerhead for essentially universal pivoting).

In another aspect the invention provides a showerhead mounted on such a joint connector.

In some forms the passageway can have in the central section a portion that narrows in a conical fashion. This then leads to a narrowed cylindrical section to define a venturi throat. Water flowing through the passageway obtains a higher velocity through the throat than upstream of the throat. The passageway then expands sharply downstream of the throat. This causes a pressure drop at the throat, causing air to be sucked in past the insert. The air becomes mixed with the water supply to create the aerated water stream.

It will be appreciated from the following description and the drawings that the present invention provides a number of advantages. First, because the air induction occurs at the ball joint, millions of existing showerheads can be retrofitted with this type of ball joint instead of the one they currently use. Hence, aeration can be provided for them.

Also, there is no spurting or leaking of water back out the air inlet port. Also, the air inlet port and associated insert are essentially hidden from view.

Further, the problem of noise due to air induction is overcome. Moreover, all these advantages can be obtained without materially increasing the cost of a standard ball joint.

These, and still other advantages, can be obtained with the present invention. While preferred embodiments are described below, the claims should be looked to in order to judge the full scope of the invention.

It is the intention of at least one embodiment of the invention to provide a joint connector including a housing having an inlet section sized and shaped to connect to a fluid supply outlet and an outlet section sized and shaped to receive a fluid dispersing member. A passageway extends axially through the housing, wherein a portion of the passageway is sized and shaped to form a venturi. A fluid pathway extends from a portion of the venturi to an exterior surface of the housing. A flow control member is disposed within the fluid pathway and the housing further includes a fluid channel transecting the fluid pathway.

In an aspect of the invention, the outlet section is spherically sized and shaped to accept a standard showerhead. Another aspect of the invention includes the venturi disposed within the outlet section. Yet another aspect of the invention includes the fluid pathway disposed within the outlet section. In another aspect of the invention, an inlet chamber is disposed in the passageway and connected to an inlet portion of the venturi. In a further aspect of the invention, a portion of the inlet chamber is disposed in the inlet section and a portion of the inlet chamber is disposed in the outlet section.

In another aspect of the invention, the fluid pathway includes a step sized and shaped to retain a portion of the flow control member. In yet another aspect of the invention, the flow control member has a flange sized and shaped to be received by the step. In a further aspect of the invention, the fluid channel is a groove disposed circumferentially around the outlet section.

In yet another aspect of the invention, a showerhead is mounted to the joint connector to form a showerhead assembly. In another aspect of the invention, the showerhead assembly includes a packing seal and a bushing, wherein the bushing has a split allowing fluid communication therethrough. In a further aspect of the invention, a gap is disposed between the packing seal and the bushing and wherein the split in the bushing is in fluid communication with the gap. In another aspect of the invention, the gap is aligned with at least a portion of the fluid channel, allowing fluid communication between the fluid pathway and a fluid volume exterior to the showerhead.

BRIEF DESCRIPTION OF THE DRAWINGS

FIG. 1 is a side elevational view of a joint connector of the present invention linking a water supply pipe and a showerhead;

FIG. 2 is an exploded perspective view of the joint connector of FIG. 1;

FIG. 3 is a cross sectional view taken along line 3-3 of FIG. 1;

DETAILED DESCRIPTION OF THE PREFERRED EMBODIMENTS

Figure 4:
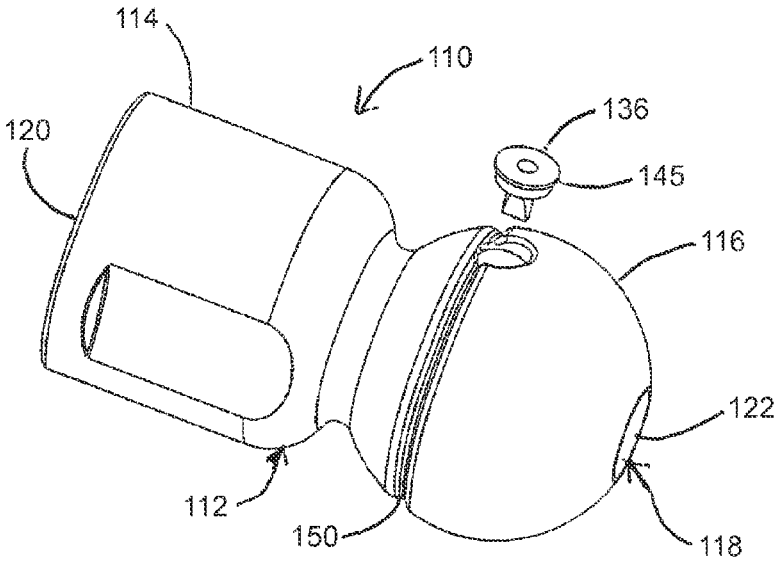
FIG. 4 is an exploded perspective view of another embodiment of a joint connector.

Ball joint connector 10 is shown threaded onto a conventional water supply line 12. The ball joint connector 10 has a generally tubular outer housing which has an inlet portion 14 and an outlet portion 16 which is generally ball-shaped. The intermediate portion there between houses an internal venturi and an air inlet port 34, as well as an axially extending passageway 18.

A passageway inlet 20 is located at an upstream end of the ball joint connector 10, and a passageway outlet 22 is located at the opposing downstream end. When installed as shown in FIGS. 1 and 3, the passageway 18 carries water from the water supply line 12 to a conventional showerhead 24.

The ball joint connector 10, apart from the insert 40, is preferably made of a metal such as brass. Standard internal threads 26 are provided in the passageway inlet 20 and are designed to threadingly engage the water supply line 12. The showerhead 24 can be movably secured to the outlet portion 16 in a known manner so as to be easily swiveled (compare the mounting system of U.S. Pat. No. 6,796,518).

The passageway 18 includes a venturi entry section 28 that provides a taper (preferably conical) to speed up the flow through a venturi throat 30. Downstream of the venturi throat 30, the passageway 18 has a venturi exit cone 32 to expand flow outwardly. The passageway 18 may further include a pocket section within which a flow regulator and/or a filter screen may be placed. The passageway 18 may further include a pocket section within which a flow regulator and/or filter screen may be placed.

When water flows through the passageway 18, the reduction provided by the venturi entry cone 28, throat 30, and exit cone 32 causes the velocity of the water to increase and the pressure to decrease. This phenomenon is well known in the art and often referred to as the Bernoulli principle.

The ball joint connector 10 has a radially extending air inlet port 34. An elastomeric insert in the form of a duck bill type check valve 36 is situated within the air inlet port 34. The reduced water pressure in the venturi throat 30 is less than the pressure of the ambient air when water is rushing through the ball joint connector 10. Due to the resulting pressure difference, ambient air is drawn into the passageway 18 through the air inlet port 34 and becomes inducted, or entrained, into the water stream contained therein.

The air inlet port 34 as shown extends transversely between the water supply passageway 18 and a flat outer upper surface portion 38 of the ball joint connector 10. Alternatively, the air inlet port 34 may extend at an acute angle. The flat outer upper surface portion 38 also facilitates use of a gripping wrench. When installed as shown in FIG. 3, an inlet end 46 of the check valve 36 is flush with the flat outer upper surface portion 38.

Still referring to FIG. 3, the air inlet port 34 joins the passageway 18 at the venturi throat portion 30. The entry point of the air inlet port 34 could alternatively be formed in other locations in the passageway 18.

In the embodiment shown, the elastomeric check valve 36 is force fit into the air inlet port 34 and through which air flows into the passageway 18. The check valve 36 permits the flow of air into the passageway 18 while preventing water (or air) from discharging out of the passageway 18. The preferred check valve design, as shown in FIGS. 2 and 3, is commonly referred to as a "duckbill" valve because its outlet end 42 has a pair of lips 44 that taper like the bill of a duck.

The check valve 36 has a cylindrical flange at its inlet end 46 configured to fit snugly within the air inlet port 34. A central bore 48 extends completely through the check valve 36. Air drawn into the bore 48 acts to drive the flexible tapered lips 44 apart, thereby permitting air flow into the passageway 18. Pressure applied against the outlet 42 of the check valve 36 acts to drive the lips 44 closed and prevent reverse flow through the check valve 36.

When first starting a shower, the check valve 36 prevents the initial surge of water from discharging out of the air inlet port 34. Similarly, if the venturi-induced vacuum is interrupted, such as by air trapped in the line, the potential exit path provided by the air inlet port 34 is blocked by the one-way nature of the check valve 36.

Surprisingly, the check valve 36 further acts to substantially reduce the level of noise. If the ball joint connector were used without an insert such as check valve 36, a shrill whistling or roaring noise is oftentimes produced. The noise level has been measured as high as ninety-five decibels just outside of the air inlet port 34.

However, it has been found that by placing a small sleeve-like insert within the air inlet port 34, the noise emanating from the ball joint connector 10 can be greatly reduced. It is believed this is occurring because a flexible sleeve absorbs and limits the sound waves, while still permitting air passage.

Figure 5:
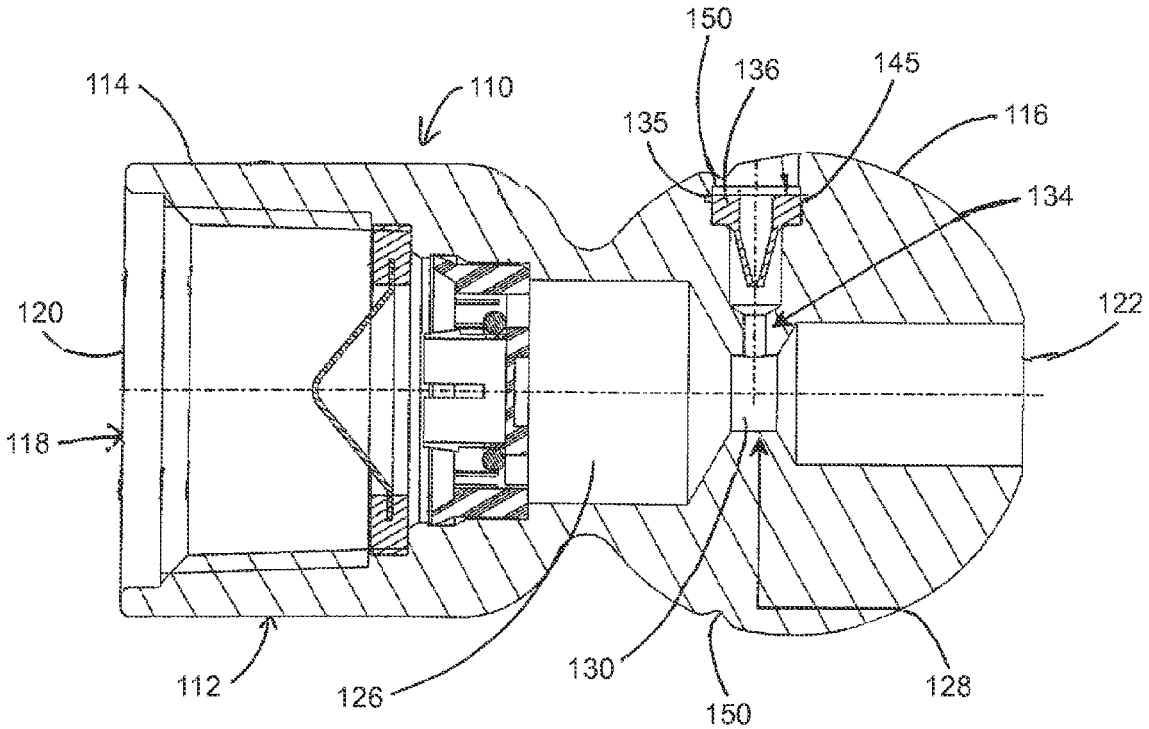
FIG. 5 is a cross sectional side view of the joint connector of FIG. 4.

FIGS. 4 and 5 illustrate another embodiment of a joint connector generally described as 110. The joint connector 110 has a housing 112 including an inlet section 114 that can have any desired shape, such as tubular, hexagonal or boxlike for example. The joint connector 110 also includes an outlet section 116 that can have any desired shape, such as spherical or cylindrical for example. The illustrated embodiment has a tubular inlet section 114 and a spherical outlet section 116.

An axially extending passageway 118 has an inlet 120 and an outlet 122 to allow for fluid to flow from a fluid supply outlet, such as the water line 12 for example, and through the joint connector 110 to a fluid dispersing member, such as a showerhead 124 for example. The passageway 118 includes a venturi 128 that can be located anywhere within the joint connector 110. The venturi 128 of the illustrated embodiment is located in the outlet section 116 and is integral with the joint connector 110, thereby requiring no extra parts to aspirate fluid such as air for example. A fluid pathway 134 connects a venturi throat 130 to an outside surface of the joint connector 110. The illustrated fluid pathway 134 is an air inlet port located in the outlet section 116, allowing the inlet section 114 to be reduced in size, thereby reducing the overall length of the joint connector 110.

A flow control member 136 is disposed within the fluid pathway 134 to prevent fluid from flowing out of the outlet section 116 through the fluid pathway 134 and to minimize noise emanating from the joint connector 110 as previously discussed. The flow control member 136 includes a flange 145 that is received by a step 135 in the fluid pathway 134, allowing the flow control member 136 to be retained within the fluid pathway 134 under high back pressure. The flow control member 136 can be any known flow control device, such as a check valve or a check ball for example. The illustrated flow control member 136 is a duck bill check valve.

An inlet chamber 126 can be disposed anywhere upstream of the venturi 128 within the passageway 118. The inlet chamber 126 can be sized and shaped in any desirable manner. The illustrated inlet chamber 126 is disposed in portions of both the inlet section 114 and the outlet section 116. The illustrated inlet chamber 126 is sized and shaped to have a large cylindrical volume, thereby providing improved fluid flow and stabilizing the fluid flow through the venturi 128.

Figure 6:
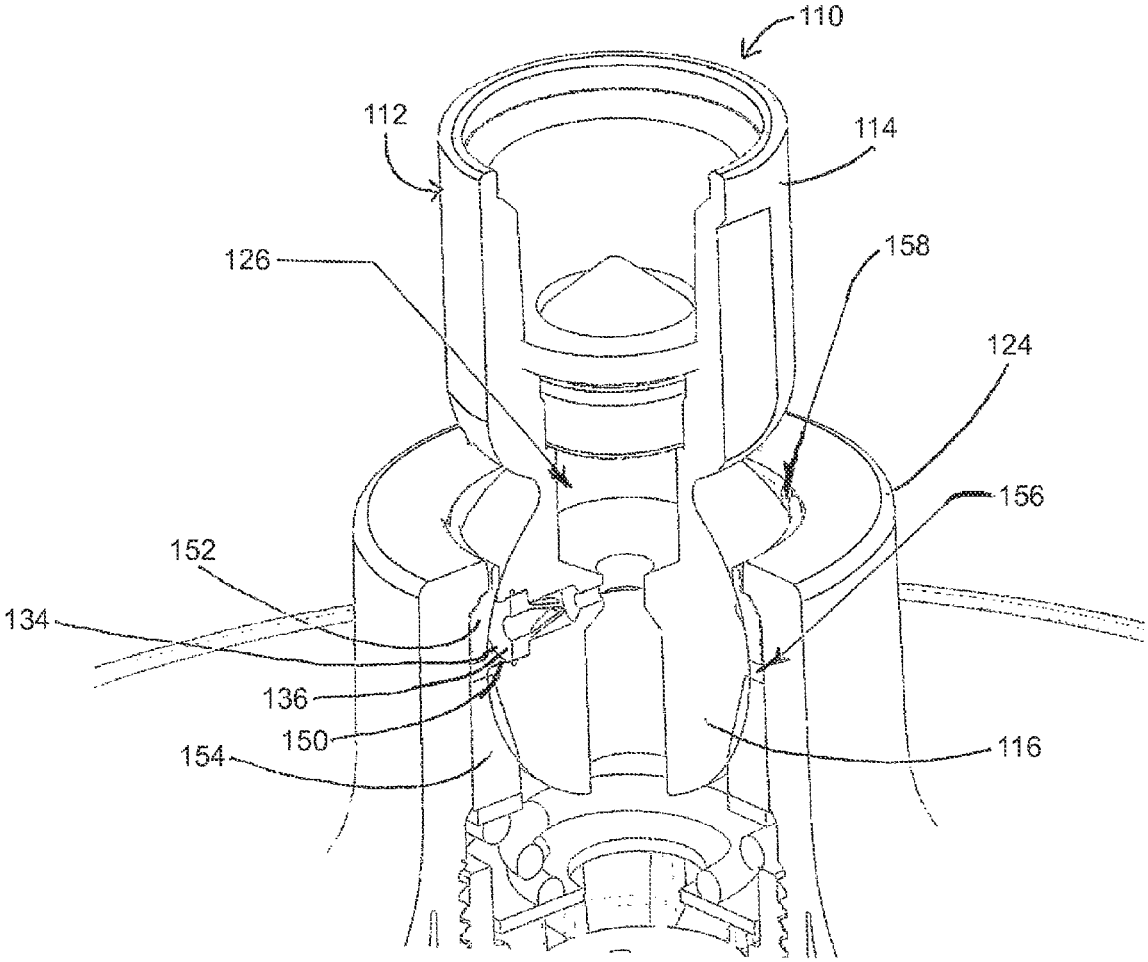
FIG. 6 is a partially cut away perspective view of a portion of a showerhead assembly including the joint connector of FIG. 4.

The outlet section 116 includes a fluid channel 150 that transects the fluid pathway 134. The fluid channel 150 can be disposed on the housing 112 in any desired orientation, shape and length. The fluid channel 150 in the illustrated embodiment is a groove disposed around the complete circumference of the outlet section 116 in a plane perpendicular to the passageway 118. As seen in FIG. 6, the fluid channel 150 provides for fluid communication between the fluid pathway 134 and an exterior environment, such as the atmosphere for example, when the fluid pathway 134 is covered, such as by a bushing 152 or a packing seal 154 in the showerhead 124 for example. The packing seal 154 and bushing 152 of the illustrated embodiment fit snugly against outlet section 116 and cover at least a portion of fluid pathway 134. A gap 156 between the packing seal 154 and the bushing 152 allows for fluid communication with the fluid pathway 134. Fluid communication between the gap 156 and the exterior environment can be provided as desired, such as through fluid ports in the showerhead or bushing for example. In the illustrated embodiment the bushing 152 includes a split 158 that intersects the gap 156 and provides fluid communication between the gap 156 and the atmosphere.

It should be appreciated that merely preferred embodiments of the invention have been described above. However, many modifications and variations to the preferred embodiments will be apparent to those skilled in the art, which will be within the spirit and scope of the invention. For example, the insert could be a rubber cylindrical sleeve, rather than a rubber or other elastomeric check valve. Therefore, the invention should not be limited to the described embodiments. To ascertain the full scope of the invention, the following claims should be referenced.

INDUSTRIAL APPLICABILITY

The invention provides a ball joint-type connector for linking a showerhead to a water supply pipe, where the connector provides aeration function with reduced noise and water waste.

The invention claimed is:

1. A joint connector for coupling a fluid supply outlet to a fluid dispersing member, the joint connector comprising:

a housing having an inlet section sized and shaped to connect to the fluid supply outlet, and a spherically shaped outlet section sized and shaped to be received in the fluid dispersing member;

a passageway extending axially through the housing, wherein a portion of the passageway is sized and shaped to form a venturi disposed within a portion of the spherically shaped outlet section that is received within the fluid dispersing member; and a fluid pathway extending from a portion of the venturi to an exterior surface of the housing.

2. The joint connector of claim 1, wherein the outlet section is sized and shaped to accept a standard showerhead.

3. A joint connector for coupling a fluid supply outlet to a fluid dispersing member, the joint connector comprising:

a housing having an inlet section sized and shaped to connect to the fluid supply outlet, and an outlet section sized and shaped to be received in the fluid dispersing member;

a passageway extending axially through the housing, wherein a portion of the passageway is sized and shaped to form a venturi disposed within the outlet section;

a fluid pathway extending from a portion of the venturi to an exterior surface of the housing, wherein the fluid pathway is disposed within a portion of the outlet section to be received within the fluid dispersing member;

a flow control member disposed within the fluid pathway; and the housing further including a fluid channel transecting the fluid pathway.

4. The joint connector of claim 1, further comprising an inlet chamber disposed in the passageway and connected to an inlet portion of the venturi.

5. The joint connector of claim 3, further comprising an inlet chamber disposed in the passageway and connected to an inlet portion of the venturi;

wherein a portion of the inlet chamber is disposed in the inlet section and a portion of the inlet chamber is disposed in the outlet section.

6. The joint connector of claim 3, wherein the fluid pathway further includes a step sized and shaped to retain a portion of the flow control member within the outlet section of the housing.

7. The joint connector of claim 6, wherein the flow control member has a flange sized and shaped to be received by the step.

8. The joint connector of claim 1, comprising:

a flow control member disposed within the fluid pathway; and the housing further including a fluid channel transecting the fluid pathway.

9. A showerhead assembly comprising:

a joint connector comprising:

a housing having an inlet section sized and shaped to connect to the fluid supply outlet, and an outlet section sized and shaped to be received in a showerhead;

a passageway extending axially through the housing, wherein a portion of the passageway is sized and shaped to form a venturi disposed within the outlet section;

a fluid pathway extending from a portion of the venturi to an exterior surface of the housing;

a flow control member disposed within the fluid pathway; and the housing further including a fluid channel transecting the fluid pathway;

a showerhead mounted to the joint connector;

a bushing located on an inlet side of the outlet section between the outlet section and the showerhead; and a packing seal located on an outlet side of the outlet section between the outlet section and the showerhead, wherein the bushing has an inlet side, an outlet side, and a split extending through the bushing from the inlet side to the outlet side allowing fluid communication through the split in the bushing.

10. The showerhead assembly of claim 9, wherein the packing seal and the bushing are spaced apart to at least partially define a gap between the packing seal and the bushing, and wherein the split in the bushing is in fluid communication with the gap.

11. The showerhead assembly of claim 10, wherein the gap is aligned with at least a portion of the fluid channel, allowing air to be drawn from a fluid volume exterior to the showerhead through the split in the bushing, into the gap and fluid channel, through the fluid pathway, and into the venturi.

12. The showerhead assembly of claim 1, wherein the venturi comprises an entrance cone, a throat, and an exit cone.

13. A joint connector configured to support a showerhead, the joint connector comprising:

a housing having an inlet section sized and shaped to connect to a fluid supply outlet, and an outlet section sized and shaped to mount a showerhead thereon;

a passageway extending axially through the housing, wherein a portion of the passageway is sized and shaped to form a venturi;

a fluid pathway extending from a portion of the venturi to an air inlet port located on an exterior surface of the outlet section, the air inlet port being located within the showerhead.

14. The joint connector of claim 13, wherein:

the outlet section is sized and spherically shaped to accept a standard showerhead;

wherein the venturi is disposed within the outlet section; and the fluid pathway is disposed within a portion of the outlet section to be received within the showerhead.

15. The joint connector of claim 1, wherein the fluid pathway extends from the portion of the venturi to an air inlet port located on the exterior surface of the outlet section, the air inlet port being located within the dispersing member.

16. The joint connector of claim 3, wherein the fluid pathway extends from the portion of the venturi to an air inlet port located on the exterior surface of the outlet section, the air inlet port being located within the dispersing member.

17. A showerhead assembly comprising:

a joint connector comprising:

a housing having an inlet section sized and shaped to connect to the fluid supply outlet, and an outlet section sized and shaped to be received in a showerhead;

a passageway extending axially through the housing, wherein a portion of the passageway is sized and shaped to form a venturi disposed within the outlet section;

a fluid pathway extending from a portion of the venturi to an exterior surface of the housing;

a flow control member disposed within the fluid pathway; and the housing further including a fluid channel transecting the fluid pathway;

a showerhead mounted to the joint connector;

a bushing located on an inlet side of the outlet section between the outlet section and the showerhead; and a packing seal located on an outlet side of the outlet section between the outlet section and the showerhead, wherein the fluid pathway extends from the portion of the venturi to an air inlet port located on the exterior surface of the outlet section, the air inlet port being located within the showerhead.

18. The joint connector of claim 3, wherein outlet section is spherical, and wherein the venturi is disposed within the spherically shaped outlet section.

19. The joint connector of claim 8, wherein the flow control member is positioned in the fluid pathway such that it is below the exterior surface of the housing.

20. The joint connector of claim 13, further comprising a flow control member located in the fluid pathway proximate the air inlet port.

21. The joint connector of claim 8, wherein the fluid channel is a groove disposed circumferentially around the outlet section.

* * * * *